United States Patent [19]

Furukawa et al.

[11] Patent Number: 4,813,903

[45] Date of Patent: Mar. 21, 1989

[54] BLOCK TOY WITH INTEGRAL DRIVE SHAFT

[75] Inventors: Masami Furukawa; Naoyuki Yamakazi, both of Tokyo, Japan

[73] Assignee: Tomy Kogyo Co., Inc., Tokyo, Japan

[21] Appl. No.: 175,617

[22] Filed: Mar. 29, 1988

Related U.S. Application Data

[63] Continuation of Ser. No. 910,607, Sep. 23, 1986, abandoned.

[51] Int. Cl.[4] ..... A63H 33/04

[52] U.S. Cl. ..... 446/90; 446/95; 446/103; 446/104; 464/179

[58] Field of Search ..... 446/104, 102, 103, 124, 446/122, 86, 90, 95, 94, 126; 403/78, 298, 292; 464/177, 179, 182, 157

[56] References Cited

U.S. PATENT DOCUMENTS

| | | | |
|---|---|---|---|
| 2,147,373 | 2/1939 | Laird | 446/124 |
| 2,491,820 | 12/1949 | Leibing et al. | 464/179 X |
| 2,861,388 | 11/1958 | Favaretto | 446/124 |
| 3,961,440 | 6/1976 | Saito . | |
| 4,493,669 | 1/1985 | Neuhierl | 446/103 |
| 4,551,110 | 11/1985 | Selvage et al. | 446/122 X |

FOREIGN PATENT DOCUMENTS

| | | | |
|---|---|---|---|
| 0104716 | 4/1984 | European Pat. Off. . | |
| 0124237 | 11/1984 | European Pat. Off. . | |
| 0170620 | 2/1986 | European Pat. Off. . | |
| 1140650 | 1/1969 | United Kingdom . | |
| 1277594 | 6/1972 | United Kingdom . | |
| 1292262 | 10/1972 | United Kingdom . | |
| 1543913 | 4/1979 | United Kingdom . | |
| 2049451 | 12/1980 | United Kingdom | 446/122 |

OTHER PUBLICATIONS

Search Report Conducted in UK, J. A. Wallis, Date: 10/27/86.

*Primary Examiner*—Mickey Yu
*Attorney, Agent, or Firm*—Staas & Halsey

[57] ABSTRACT

A running toy having an integral and concealed transmission member permits easy construction of running toys having a desirable appearance. A block unit of the running toy includes a hollow cube or block having a concave portion for receiving other block units and a convex portion for coupling to other block units. The concealed transmission member is rotatably mounted within the hollow cube so as to permit successive block units to be connected, and top permit a drive force inputted to one end of a succession of block units, from a power unit and through a power transmission, to be output at another end of the succession of block units. The succession of blocks can be configured in any desired shape, such as a crane.

12 Claims, 9 Drawing Sheets

BLOCK TOY WITH INTEGRAL DRIVE SHAFT

This is a continuation of co-pending application Ser. No. 910,607 filed on Sept. 23, 1986, now abandoned.

BACKGROUND OF THE INVENTION

The present invention relates to a block toy; and more particularly to the structure of a block toy utilized in constructing a running toy. Typically, children and others use block toys by connecting several blocks (or components) into a desired shape such as a vehicle, an animal, or any other shape. A component of a block toy is a block unit or housing. A block unit or housing has a geometrical shape such as a rectangular parallelopiped, cylinder or sphere. Typically, block units or housings are adapted for connecting various block units or housings together into a static shape such as described above.

Running toys can also be constructed using block units such running toys combine block units with a power device to drive movable members of the block units. Commonly, the power device comprises a motor and the movable members comprise wheels. The appearance of such block toys, however, is not desirable because a power transmission mechanism must be attached to the block units after the completion of a running toy block assembly. The transmission mechanism delivers a drive force from the power device to the wheels. In addition, unsightly support members must be employed to hold a power transmission mechanism positioned outside of the unit blocks.

SUMMARY OF THE INVENTION

An object of the present invention is to provide a block toy capable of being combined to form desired shapes.

Another object of the present invention is to provide a block toy capable of constructing a running toy.

A further object of the present invention is to provide a block toy capable of constructing a running toy with a concealed transmission mechanism.

Still another object of the present is to provide a block toy having a desirable appearance.

To achieve the above and other objects, the present invention comprises a block toy connectable to receive a drive force. The block toy includes a housing having a concave portion formed therein; coupling means, attached to the housing, for connecting the housing to another housing; and transmission means, rotatably mounted in said housing, for transmitting the drive force through said housing.

In a preferred embodiment of the present invention, the housing comprises a hollow cube or block unit having an open face providing a concave portion of the housing. The coupling means comprises a collar mounted on the housing and dimensioned so that the collar can fit into the open face of another housing. The transmission means in a preferred embodiment of the present invention includes a shaft having a recess formed in one end and protrusions shaped to slidably engage the recess of another transmission means.

DETAILED DESCRIPTION OF PREFERRED EMBODIMENT

Figure 1A:
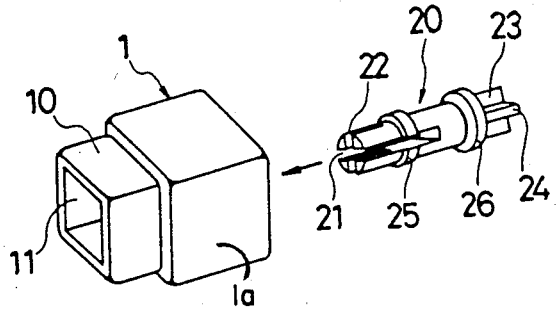
FIGS. 1(A) and 1(B) are isometric views of a block housing and transmission member according to the present invention.
Figure 1B:
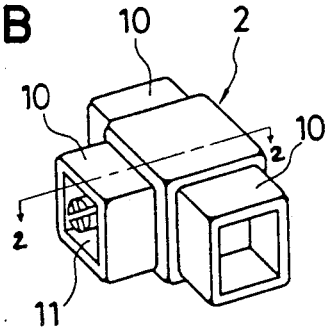

FIGS. 1(A) and 1(B) illustrate two types of block units, 1 and 2. These block untis include a transmission shaft 20. Block unit 1 shown in FIG. 1(A) comprises a hollow cube housing 1*a*, with slightly beveled corners. Integrally formed with the hollow cube housing 1*a* is a convex or coupling portion 10. The dimensions of the convex or coupling portion 10 are such that the coupling portion 10 frictionally engages an opening or convex portion 12 (FIG. 2) of another block unit. In the following, a block unit such as illustrated in FIG. 1(A) is referred to as a linear block.

FIG. 1(B) illustrates a second type of block unit. The block unit 2 comprises a cubic hollow member (similar to 1*a* shown in FIG. 1(A)), and three convex portions 10 on three adjoining faces of the cubic member. The block unit 2 can be used to, for example, join lines of linear blocks crossing at right angles to each other, such as the block 2' shown in FIG. 3. In the following, the block illustrated in FIG. 1(B) is referred as a cross block.

Figure 2:
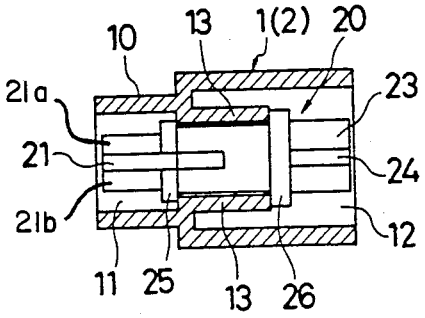
FIG. 2 is a cross-sectional view of the block housing unit shown in FIGS. 1(B)

Referring to FIG. 2, the inside of the hollow member of the linear (e.g., 1*a* in FIG. 1(A)) and cross blocks illustrated in FIGS. 1(A) and 1(B) are formed so as to accept a transmission shaft 20. The transmission shaft 20 comprises a shaft with a generally circular cross-section. A first end of the shaft has two slots 21 and 22 crossing at right angles to each other; slot 21 being deeper than slot 22. The opposite face of the shaft, or second end, includes two crossing projections, 23 and 24. These projections are dimensioned so that they fit into the slots 21 and 22 of another transmission shaft. The first end of the transmission 20 has a smaller diameter than the middle portion of the shaft (i.e., the region between elements 25 and 26). The second end of the transmission shaft 20 has larger diameter than the middle portion. The borders between the first end, the middle portion and the second end are provided with elements 25 and 26. Elements 25 and 26 are not necessarily protrusions integrally formed with the shaft as shown. Instead, they can be for example, rings fitted on to the shaft. Referring to FIG. 2, a cylindrical bearing 13 is structured to accept the middle portion of the transmission shaft 20. The transmission shaft 20 freely rotates within the bearing 13, and is held within the bearing 13 by protrusions 25 and 26 which abutt the ends of the bearing 13.

In order to accept the transmission shaft 20, the bearing 13 can comprise flexible material capable of compressing a top half 21*a* of the first end of the transmission shaft 20 and a bottom half 21*b* of the transmission shaft 20 towards one another in order to fit through the bearing 13. As will be understood by those skilled in the art, the protrusions 25 and 26 need not be integrally formed with the transmission shaft 20, and can be, for example, rings fitted on the shaft after the shaft is positioned within the bearing 13, or any other abutment type member. The top half 21*a* and bottom half 21*b* can be tapered to facilitate insertion into the bearing 13.

Figure 3:
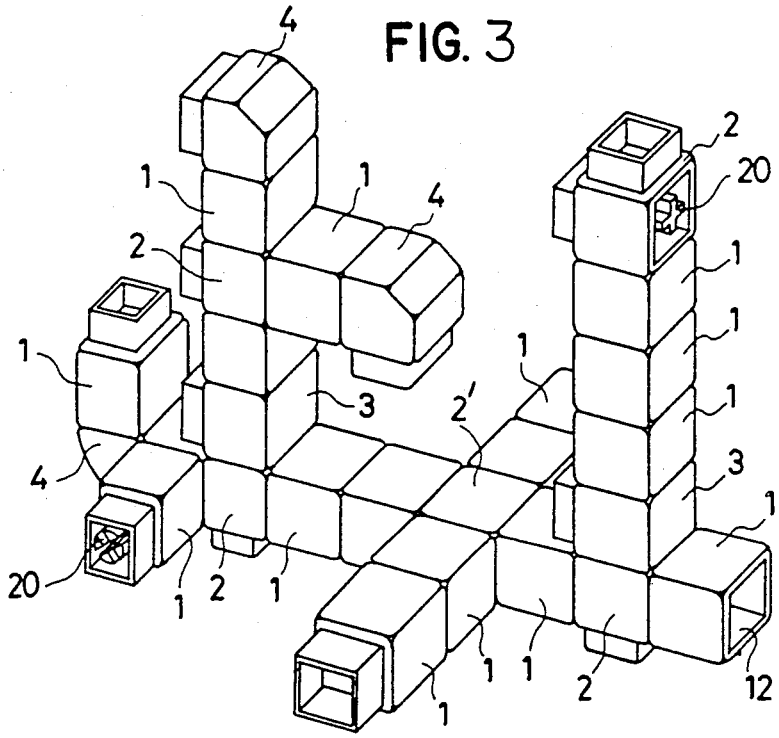
FIG. 3 illustrates one use of the block units of the present inventions.
Figure 4A:
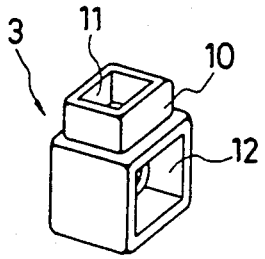
FIGS. 4(A) and 4(B) illustrate other shapes for block units according to the present invention.
Figure 4B:
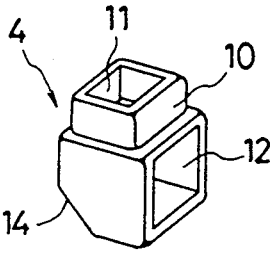

FIG. 3 illustrates one application of the block toy of the present invention. FIG. 3 employs the linear block (FIG. 1(A)) and the cross block (FIG. 1(B)) in addition to two additional types of blocks as illustrated in FIGS. 4(A) and 4(B). Referring to FIG 4(A) a block unit 3 comprises a cube housing similar to 1*a* of linear block 1 (FIG. 1(A)). In block unit 3 the convex or coupling portion 10 is positioned on a face other than that opposing the concave portion 12 of the unit. The block unit 3 therefore facilitates connecting blocks at right angles to each other. A block unit 4 shown in FIG. 4(B) has a structure similar to that block of unit 3, with the exception that block unit 4 includes a beveled face 14.

Figure 5:
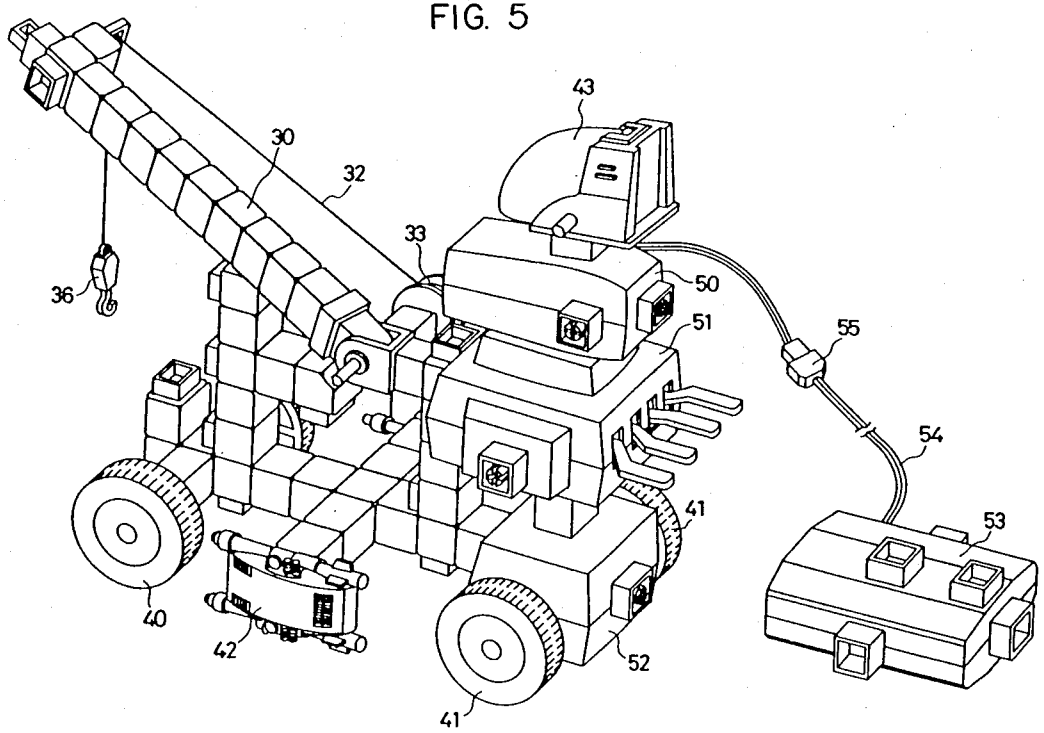
FIG. 5 illustrates a toy comprising block units of the present invention.

The frame structure shown in FIG. 3 is constructed using the above-discussed type of block units (i.e., units 1, 2, 3 and 4). The block units connect together via their respective concave or coupling portions 10 and convex portions of other block units. The FIG. 3 frame can be used, for example, as a base frame for a running toy such as shown in FIG. 5. More specifically, when a running toy is equipped with a crane 30 as shown in FIG. 5 the frame structure shown in FIG. 3 is first constructed and then provided with the accessories such as a crane 30, front wheels 40, rear wheels 41, a frame cover 42, a cab 43 and similar accessories as shown in FIG. 5. In addition, attaching a power unit 50, a power switching unit 51 and a power transmission unit 52 to the toy provides a functional electrical running toy. A separate battery unit 53 can be employed to supply electric power to a motor within the power unit 50. The battery unit 53 can be connected to the power unit 50 via, for example, a lead wire 54 and a wire connecting joint 55.

Figure 6:
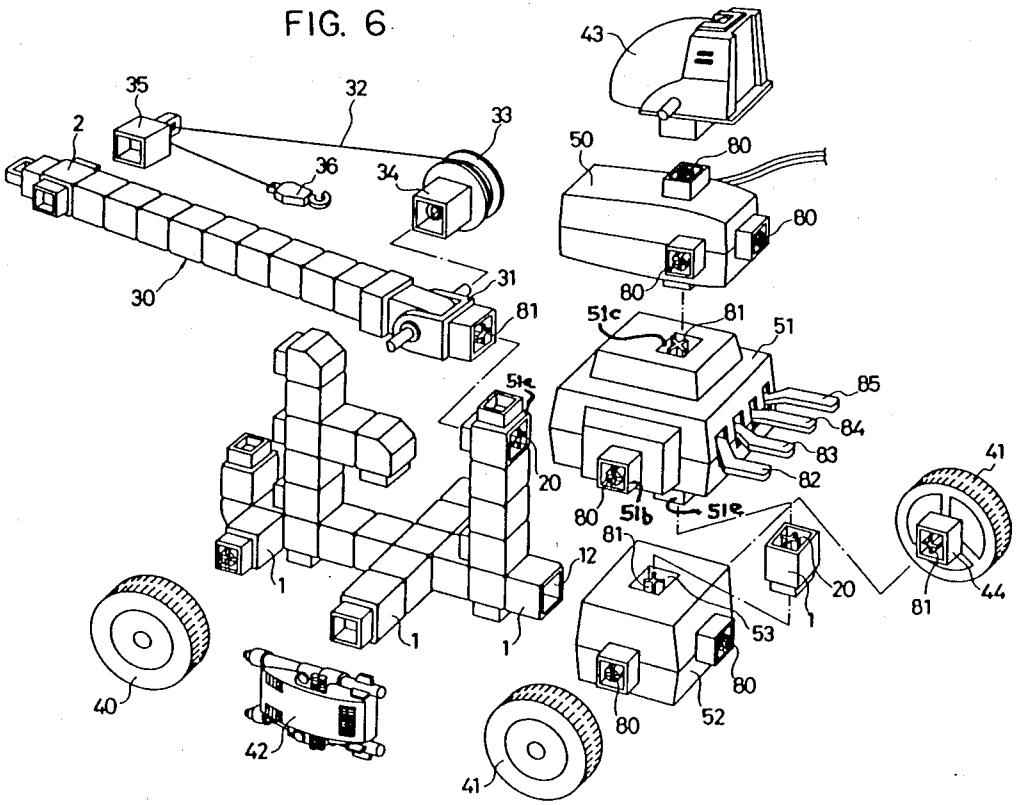
FIG. 6 is an exploded view of the toy shown in FIG. 5.

FIG. 6 is an exploded view of the running toy shown in FIG. 5. Referring to FIG. 6, a set of front wheels 40 rotatably connect to linear block units 1 protruding from the right and left straight frame center portion of the running toy (i.e., the frame structure shown in FIG. 3). The power transmission unit 52 connects to the rear end of the FIG. 3 frame by fitting the concave portion 12 of the frame onto a convex portion of the power transmission unit 52. The rear wheels 41 include a block unit 44 for rotatably mounting the wheels 41 onto a convex portion of the power transmission 52 and for engaging transmission members 80 which protrude from the power transmission unit 52.

The power switching unit 51 connects to the upper side of the power transmission unit 52 via a linear block 1 having a power transmission shaft 20 such as shown in FIG. 1(A). The power unit 50 and a cab 43 are connected to the upper side of the power switching unit 51. A cross block 51*a* including a transmission shaft 20 accepts, in its concave portion, a convex portion of the power switching unit 51 such as the portion 51*b*, but positioned on the face of the power switching unit 51 opposite a set of switches 82, 83, 84 and 85. In this assembly, the rotary power from the motor housed within the power unit 50 is selectively transmitted through the switching unit 51 to the transmission unit 52, and from the transmission unit 52 to the rear wheels 41 and, via the frame portion (illustrated in FIG. 3) to the crane 30. A cover 42, shown in FIG. 6, simulates a crane operator's cab.

As shown in FIG. 6, the crane 30 attaches to the frame structure (shown in FIG. 3) via a concave portion of a hinged rotation transmission block 31 engaging a convex portion of the cross block 51*a*. The crane 30 comprises a number of linear blocks attached to the hinged rotation transmission block 31. The hinged rotation transmission block 31 includes shaft 160 (FIG. 12) on which a pully 33 is mounted. The pully 33 winds a string 32 to effect a crane operation. A string 32 passes through hang block 35 attached to a cross block 2 (FIG. 1(B)), and has connected thereto a crane hook 36.

Figure 7:
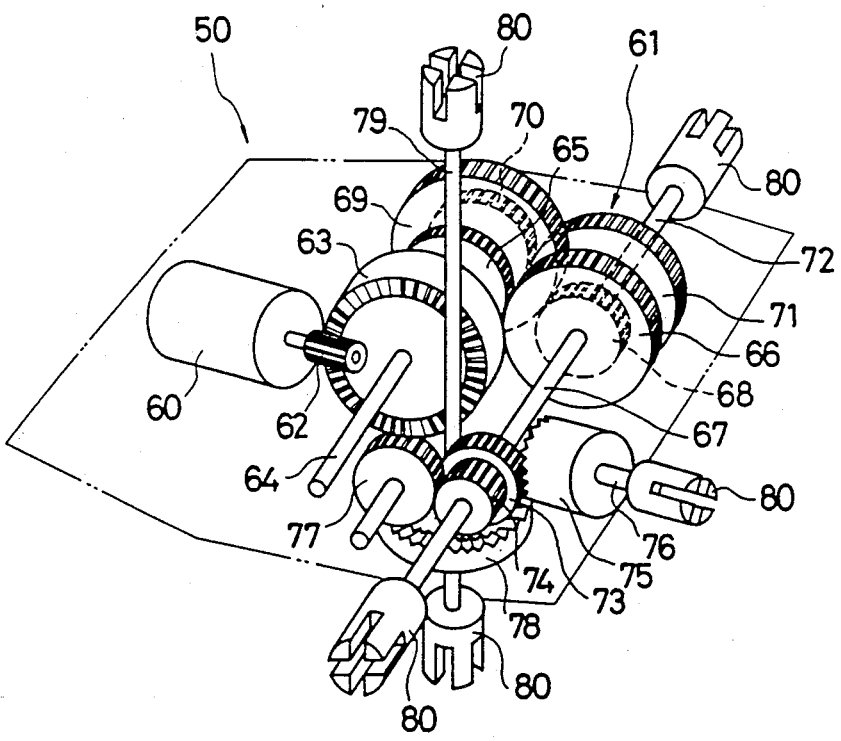
FIG. 7 illustrates a power unit employed in the toy shown in FIG. 5.

The driven portions the running toy shown in FIG. 6 include the rear wheels 41, the pully 33 and a three element transfer mechanism which transmits the rotary power of the motor in the power unit 50 to the driven portions of the running toy. The following discusses each of the transfer mechanism's three elements. First, the power unit 50 (shown in FIG. 7) is enclosed within a casing having the shape of a rectangular parallelopiped and includes a motor 60 and a gear mechanism 61 which provides the drive force in five different directions at five outputs. The gear mechanism 61 has a crown gear 63 which engages a pinion 62 fixed to a shaft of the motor 60. The crown gear 63 rotates a left side output shaft 67 via a spur gear 65 fixed to a shaft 64 on which the crown gear 63 is mounted. The rotation of the left side output shaft 67 is reductively transmitted to a right side output shaft 72 via a series of reduction gears 68, 69, 70 and 71. Also fixed to the output shaft 67 are a large gear 73 and a smaller gear 74. The large gear 73 engages a crown gear 75 to rotate a backward output shaft 76. The little gear 74 rotates an upward and downward shaft 79 via a spur gear 77 and a crown gear 78.

The ends of the shafts 67, 72, 76 and 79 which output the drive force in the above-mentioned five directions protrude from the rectangular parallelopiped casing and have attached thereto female type transmission members 80 having a cross slot with the same configuration as the cross slot of the transmission member 20 shown in FIG. 1. Therefore, by engaging the transmission members 80 with either a transmission member 20 or a male type transmission member 81 (FIG. 6), the drive force provided by the rotation of the motor 60 is output in each of the five (5) directions shown in FIG. 7.

Figure 8:
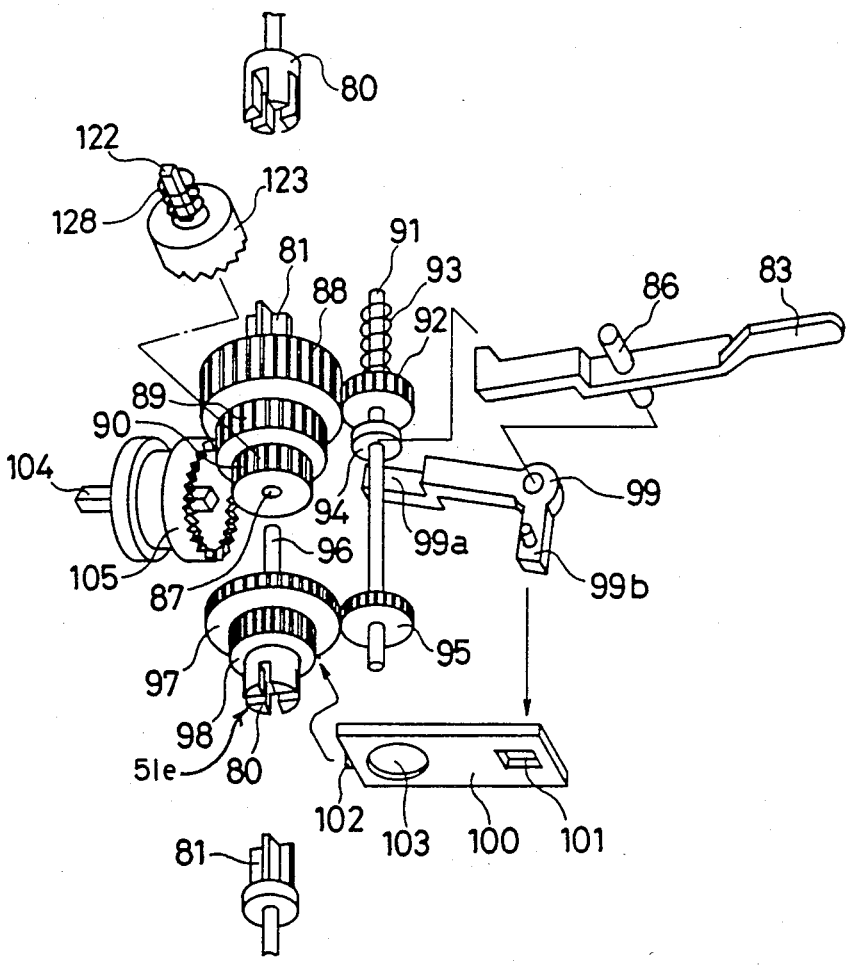
FIGS. 8, 9 and 10 illustrate a power switching unit employed in the toy shown in FIG. 5.
Figure 9:
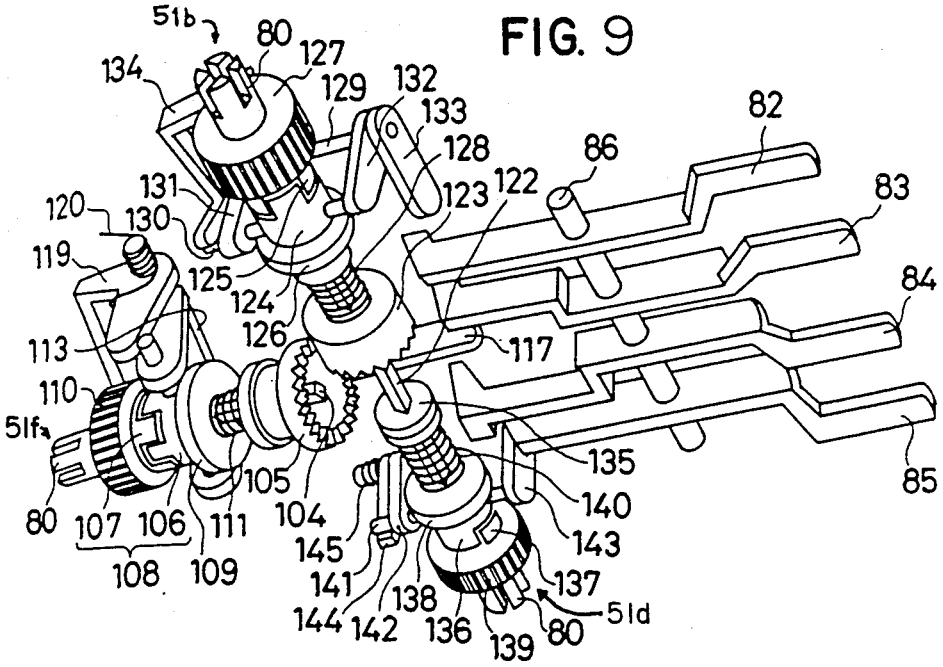
Figure 10:
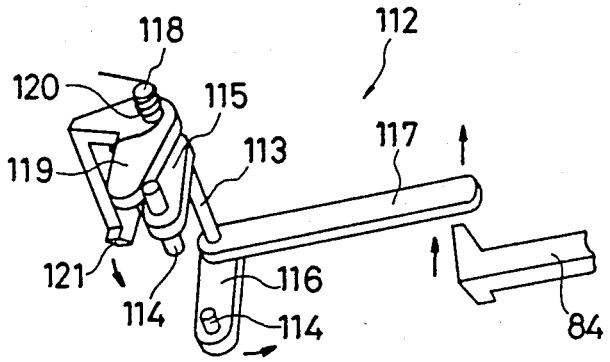

The second driven element of the above-mentioned transfer mechanism is the switching unit 51 shown in FIGS. 8, 9 and 10. The power switching unit 51 can be encased in a rectangular parallelopiped casing similar to that enclosing the power unit 50. The switching unit 51 functions to receive a drive force from, for example, the power unit 50, and to selectively supply the received drive force to any one of a number of rotation outputs. Referring to FIGS. 6 and 9, the power switching unit 51 selectively transmits the drive force received at the input 51*c* to the rotation outputs 51*b*, 51*d*, 51*e* and 51*f* in accordance with the position of the four switching levers 82, 83, 84 and 85. As shown in FIG. 9, when any one of the switching levers 82, 83, 84 and 85 are pushed up, the drive force is transmitted to the corresponding output; and when the lever is pushed down the drive force does reach the output.

FIG. 8 illustrates a switching mechanism associated with the lever 83. Switching lever 83 as well as the switching levers 82, 84 and 85 pivot about a common axis 86. Each of the switching levers togles and stays in either an up or a down position until moved out of that position. Referring to FIG. 8, a drive force is received via a male type transmission member 81 mounted on an input shaft 87 and a female transmission member 80 which can be, for example, transmission member 80 mounted on the drive shaft 79 of the power unit 50.

The operation of the power switching unit to provide drive force to the downward rotation output 51*b*, to the forward rotation output 51*f* and to the left and right rotation outputs 51*b* and 51*d*, respectively are discussed below. FIG. 8 illustrates the switching mechanism associated with the downward rotation output 51*e*. Three spur gears 88, 89 and 90 are also attached, as a unit, to the input shaft 87. The spur gear 88 engages a spur gear 92 fixed to a rotation shaft 91 which is freely moveable in direction parallel to the direction of the input shaft 81. The width of the spur gear 88 is determined so as to ensure that the spur gear 88 maintains engagement with the spur gear 92 regardless of any movement of shaft 91 that is induced by the switching lever 83. A spring 93 positioned about the rotation shaft 91 ensures that the spur gear 92 returns to a lower limit position when released by the lever 83.

The top edge of the switching lever 83 contacts a lower face of a flange 94 as indicated in FIG. 8. An end portion 99*a* of an L-shaped rotative member 99 is also positioned below the flange 94 as shown in FIG. 8. The rotative member 99 is attached to the switching lever 83 so as to rotate up and down together with the switching lever 83. Another end portion 99*b* of the rotative member 99 is positioned within a square area 101 of a stopper plate 100. The stopper plate 100 includes a front projection 102 for prohibiting rotation of the output shaft 96 by engaging a knurled roller 98. The stopper plate 100 also includes a perforation 103 which permits the lower portion of the rotation shaft 91 to be moved up and down by the switching lever 83 without being obstructed by the stopper plate 100.

When the switching lever 83 is raised up as shown in FIG. 8, a spur gear 95 engages spur gear 97 mounted on the output shaft 96. At the same time the end 99*a* of the rotative member 99 is in a downward position, separating the front end projection 102 of the stopper plate 100 from the knurled roller 98. Accordingly, rotation of the input shaft 87 is transmitted to the output shaft 96 via the rotation of shaft 91.

When the switching member 83 is pushed down (i.e., positioned in the off position), the top of the switching lever 83 raises the flange 94, causing disengagement of the spur gear 95 from the spur gear 97. Simultaneously, the rotative member 99 rotates clockwise so that the stopper plate 100 moves forward and the front end projection 102 engages the knurled roller 98 so as to stop rotation of the output shaft 96.

In summary, the up and down position of the switching lever 83 controls the rotation of the output shaft 96. The rotation of the output shaft 96 can be transmitted to any transmission member such as the input shaft of the power transmission unit 52 or the transmission shaft 20 of a block unit.

Referring to FIGS. 8 and 9, movement of the rotation output 51*f* is as described below. In FIG. 8, spur gear 89 engages the crown gear 105 fixed to an output shaft 104. As shown in FIG. 9 a clutch mechanism 108 including two cylindrical clutch members 106 and 107 is positioned in front of the crown gear 105. Concave and convex portions of the clutch member 106 and 107 engage each other causing rotation of a transmission member 80 of the rotation output 51*f*. Clutch member 106 includes a flange portion 109 positioned on the side opposite the concave/convex portion of the clutch member 106. Clutch member 107 includes a knurled roller 110 similar to the knurled roller 98. The knurled roller 110 rotates independently of the output shaft 104 and cannot be moved in the axial direction of the shaft 104. In operation, the clutch member 106 is biased towards and engages the clutch member 107 due to the force of a coil spring 111 positioned between the crown gear 105 and the clutch member 106.

FIG. 10 illustrates a clutch release mechanism 112 which is positioned above the clutch 108. The clutch release mechanism 112 comprises a pair of clutch release members 115 and 116 which are fixed to ends of a supporting axis 113 as shown in FIG. 10. The release members 115 and 116 each include connections 114 which contact the clutch member 106. A pivot member 117 has one end thereof pivotally supported by the axis 113, and has another end positioned over the top of the switching lever 84. A stopper member 119 is rotatably mounted on a pivot point 118 formed on the outside of clutch release member 115. A spring 120 biases the stopper member 119 so as to move in a clockwise direction and abut projection 114 on release member 115 as shown in FIG. 10. One end of the stopper member 119 includes an angular projection 121 which engages the knurled roller 110 so as to prohibit rotation of this roller.

When the switching member 84 is an up position as shown in FIG. 9, the pivot member 117 is in an almost horizontal state, causing the projection 121 of the stopper member 119 to be separated from the knurled roller 110 through the rotation of the clutch release member 115. The clutch members 106 and 107 are engaged and therefore transmit the drive force due to the rotation of the crown gear 105 to the output shaft 104 and therefore to the female type transmission member 80 formed as a unit with the knurled roller 110.

By pushing the switching lever 84 down, (i.e., to the off position), the top of the switching member 84 is moved in the direction of the arrow shown in FIG. 10. This raises the rear portion of the pivot member 117 in the direction of the arrow shown in FIG. 10. As a result, the clutch release members 115 and 116 are rotatably moved in the direction of the arrow shown in FIG. 10, causing the support axis 113 and the projections 114 to abut against the flange 109 of clutch member 106 and push clutch member 106 towards the crown gear 105, disengaging clutch members 106 and 107. At the same time, the stopper member 119 is rotated by the force of spring 120 so as to bring projection 121 into engagement with the knurled roller 110. This halts the rotation of the knurled roller 110 and as a result, the rotation of the transmission member 81 at the rotation output 51*f*.

In summary, rotation of the transmission member 80 at the rotation output 51*f* is initiated or halted by the operation of the switching lever 84 as discussed above. The drive force transmitted to the transmission member 80 at the rotation output 51*f* can be transmitted to a subsequent transmission member 20 or a, male type transmission member 81 of, for example, the power transmission unit 52.

The rotation of the female type transmission member 80 at the rotation of output 51*e* is discussed below. As shown in FIG. 9, a right and left output shaft 122 has a crown gear 123 attached to a central portion of the shaft 122. The crown gear 123 engages the spur gear 90 (as schematically shown in FIG. 8) fixed to the input shaft 87 shown in FIG. 8.

A clutch comprising two cylindrical clutch members 124 and 125 is positioned to the left of the crown gear 123. Concave and convex portions of the clutch members 124 and 125 are biased into engagement by a spring 128. Clutch member 125 has a flange portion 126, and is freely movable in the axial direction of the shaft 122. The clutch member 125 is formed as a unit with a knurled roller 127 which rotates independently of the shaft 122, but cannot be moved in the axial direction of the shaft 122.

As seen in FIG. 9, a clutch release mechanism similar to that shown in FIG. 10 is positioned over the clutch members 124 and 125. The left side clutch release mechanism includes a pair of clutch release members 131 and 132 which are fixed to ends of a supporting axis 129. The clutch release members 131 and 132 have projection 130 formed thereon, which projections contact the clutch member 124 and flange 126. A pivot member 133 of the clutch release mechanism has one end pivotably supported by the axis 129, and has another end positioned over the top of the switching lever 82 in a manner similar to pivot member 117 described with reference to the switching lever 83. A stopper member 134 is rotatably mounted in a manner similar to the stopper member 119 shown in FIG. 10. The stopper member 134 operates to engage the knurled roller 127 in a manner similar to the engagement and disengagement of the stopper member 119 with respect to the knurled roller 110.

When the switching lever 82 is in an up position as shown in FIG. 9, the pivot member 133 is in an almost horizontal state. The projection of the stopper member 134 is therefore separated from the knurled roller 127 via the clutch release member 131. The clutch members 124 and 125 are engaged and therefore transmit the drive force due to the rotation of the crown gear 123 to the shaft 122 and to the transmission member 80 at the rotation output 51*b*.

By pushing the switching lever to a down position, the top of a switching lever 82 raises the rear portion of the pivot member 133. This causes the clutch release members 131 and 132 to rotated towards the flange 126, causing the flange to compress the spring 128 and disengage the clutch members 124 and 125. At the same time, the stopper member 124 is rotated due to the force of a spring (not shown) similar to the spring 120 shown in FIG. 110, and the projection on the stopper member engages the knurled roller 127, halting rotation of the knurled roller 127 and the corresponding rotation of the transmission member 80 at the rotation output 51*b*.

Motion of the rotation output 51*d* shown in FIG. 9 is described below. The rotation of the transmission member 80 at the rotation output 51*d* is controlled in a manner similar to that of the transmission member 80 of the rotation output 51*b*. As shown in FIG. 9, a spring retainer 135 is fixed to the shaft 122. A clutch mechanism including clutch members 136 and 137 is disposed to the right of the spring retainer 135, and a spring 140 biases the clutch member 136 into engagement with the clutch member 137. Clutch member 136 has a flange member 126 which, together with the clutch member 136 is freely movable in the axial direction of the shaft 122. The clutch member 137 has formed therewith a knurled roller 139 which together with the clutch member 137 rotates independently of the shaft 122, but cannot be moved in the axial direction of the shaft 122.

A clutch release mechanism such as illustrated in FIG. 10 is positioned above the clutch members 136 and 137. The clutch mechanism includes clutch release members 142 and 143 which are fixed to a supporting axis (not shown) similar to the axis 113 in FIG. 10. The clutch release members 142 and 143 have projections 141 which contact the clutch member 136. In the clutch release mechanism positioned above clutch members 136 and 137, the spring 145 and stopper member 144 function as the spring 120 and stopper member 121 of the clutch release mechanism shown in FIG. 10.

When the right side switching member 85 is in the up position as shown in FIG. 9, a pivot member (not shown, but similar to 117 shown in FIG. 10) is in an almost horizontal state. As a result, the stopper member 144 is separated from the knurled roller 139 via the clutch release member 142. The clutch members 136 and 137 are engaged and held in such state by the spring action of the spring 140. When the switching lever 85 is in the down position, the top of the switching lever 85 raises the end of the pivot member (not shown), so that the clutch release members 142 and 143 are rotated in a direction so as to push against the flange 138 and disengage the clutch members 136 and 137. At the same time, stopper member 144 is rotated so as to engage in a knurled roller 139 and stop its rotation.

Figure 11:
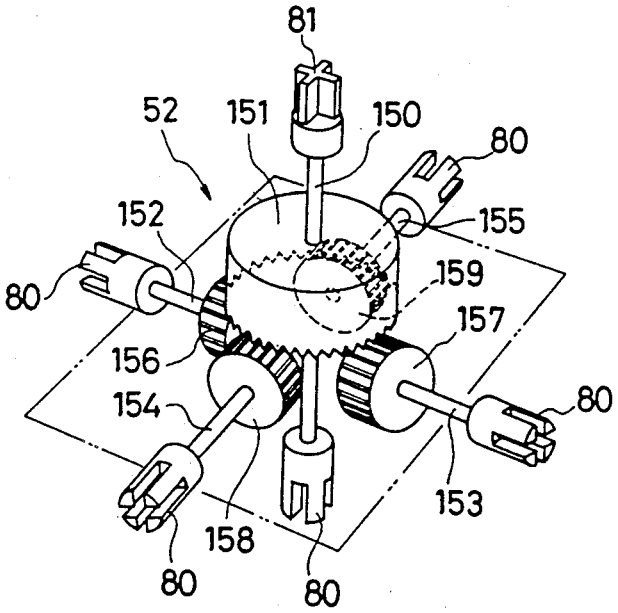
FIG. 11 illustrates a power transmission unit employed in the toy shown in FIG. 5.

The third element of the above-mentioned transfer mechanism is the power transmission unit 52 shown in FIG. 11. The power transmission unit 52 includes a male transmission member 81 which, referring to FIG. 6, protrudes from an opening 53 in a housing for the power transmission unit 52. This transmission member 81 can receive a drive force from, for example, the power switching unit 51 via a linear block 20 such as illustrated in FIG. 6. The transmission member 81 transmits the received drive force via a shaft 150 (FIG. 11) to a crown gear 151 mounted on the shaft 150. The crown gear 151 engages spur gears 158 and 159 respectively fixed to shafts 154 and 155; and engages spur gears 156 and 157 respectively attach to shafts 152 and 153. Shaft 150 extends through the crown gear 151 and has connected thereto a female transmission member 80. Thus, the drive force received by the transmission member 81 is transmitted via the shaft 150 and crown gear 151 in five directions through shafts 150, 152, 153, 154 and 155.

Referring to FIG. 6, the transmission members 80 on the right and left sides of the power transmission unit 52 are coupled to blocks 44 to provide a drive force to the wheels 41. Thus, rotation of the rear wheels 41 can be controlled by operating switching lever 83 of the switching unit 51.

Figure 12:
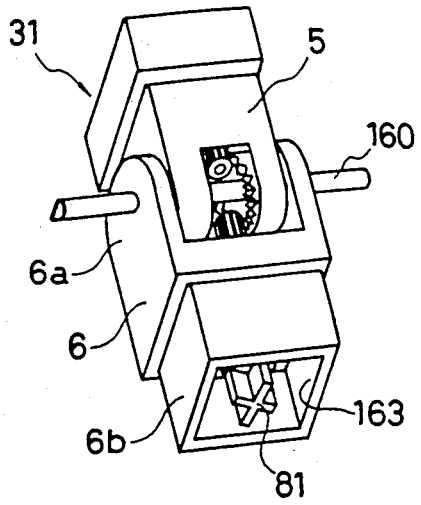
FIG. 12 is an isometric view of a hinged rotation transmission block unit employed in the toy shown in FIG. 5.
Figure 13:
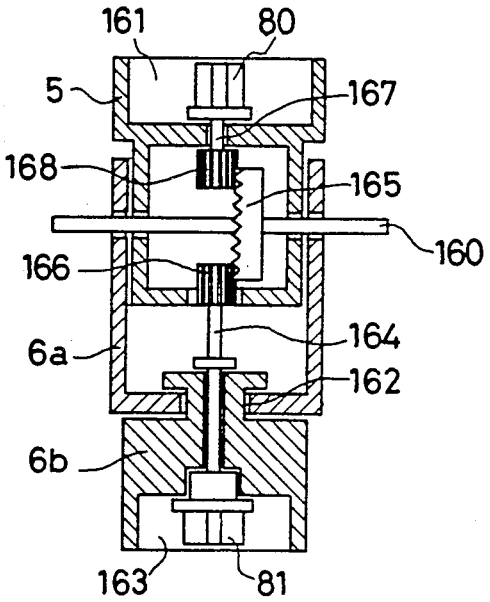
FIG. 13 is cross-sectional view of the hinged rotation transmission block unit shown in FIG. 12.

FIGS. 12 and 13 illustrate a hinged rotation transmission member 31 employed in the running toy illustrated in FIG. 5. In FIG. 5, the hinged rotation transmission member 31 connects the crane 30 to the frame illustrated in FIG. 3. The hinged rotation transmission member 31 comprises two block units 5 and 6 which rotate about a shaft 160 having, for example, a D-shaped cross-section. One end of the block unit 5 has a square opening 161 dimensioned to receive, for example, the convex portion 10 of a linear block. The block unit 6 includes a portion 6*a* which slidably engages another end of the block unit 5, and permits the block unit 5 to freely rotate about the shaft 160. A convex portion 6*b* is connected to the block 6 and has a recess 163 dimensioned so as to receive the concave portion of, for example, a linear block. Referring to FIG. 13, a transmission member 81 is fixed within the portion 6*b* and within the recess 163. The transmission member 81 is mounted on one end of a shaft 164, which has mounted on the other end a pinion 166. The pinion 166 engages a crown gear 165 to impart rotation to the shaft 160. The block unit 5 includes a recess 161 having a transmission member 80 housed therein. The transmission member 80 is mounted on one end of a shaft 167, which has mounted on the other end a pinion 168. The pinion 168 also engages the crown gear 165.

The hinged rotation block 131 can transmit a rotational force received at the transmission member 81 to both the shaft 160 and the transmission member 80. Since the block units 5 and 6 rotate about shaft 160 on which the crown gear 165 is mounted, pinions 166 and 168 maintain engagement with the crown gear 165 regardless of the pivotable relationship between the block units 5 and 6.

As discussed above, the hinged rotation transmission member 31 is employed in the running toy shown in FIGS. 5 and 6 and connects the crane 30 to the frame shown in FIG. 3. In FIG. 6, a pully 33 is connected via a block 34 to the shaft 160. Thus, rotation of the pully 33 is controlled via action of the switching lever 85 which controls the motion of the transmission member 80 at the rotation output 51*f* shown in FIG. 9.

It will be recognized by those skilled in the art that the inventive block toy of the present invention is not limited to the detailed embodiment described above. For example, the transmission shaft 20 does not need to have a cross slot or cross projections, and can include any suitable connection structure. In addition, the position on the transmission shaft 20 of the cross-slots and cross projections can be reversed.

The block toy according to the present invention permits block units to be connected to form running toys having desirable appearances. The running toy described in FIGS. 5 and 6 merely illustrates one embodiment of the present invention. The scope of the present invention is not limited to the illustrated embodiment and instead is defined by the following claims.

What is claimed is:

1. A block toy comprising:

a plurality of block units, each block unit including:

a housing having a concave portion formed therein;

a coupling portion attached to the housing and dimensioned to fit in a concave portion of another housing; and a shaft rotatably positioned within said housing, said shaft having a first end with a recess formed therein and a second end having a protrusion dimensioned to fit in the recess of another shaft, power means, operatively connected to one of said block units and to said shaft within said one of said block units, for providing a driving force to said shaft so as to rotate said shaft;

power switching means, operatively connected between said one of said block units and said power means, for receiving said drive force and for selectively providing said drive force to a plurality of rotatable outputs, each output being operatively connectable to said block units;

power transmission means, operatively connected between said power switching means and said one of said block units, for receiving said drive force from said power switching means and for transmitting said drive force to a plurality of outputs, each output being operatively connectable to said block units; and hinged transmission means, having an input end connectable to said one of said block units, an output end rotatably connected to said input end, and being connectable to another one of said block units, for receiving said drive force at said input end and for transmitting said driving force to said output end regardless of the orientation of the output end with respect to said input end, so as to rotate said shaft of the another one of said block units.

2. A block toy according to claim 1, configured as a crane.

3. A block toy connectable to receive a drive force, comprising:

a housing having a longitudinal axis and first and second opposing concave portions formed therein and about the longitudinal axis;

coupling means, fixedly attached to said housing and positioned around the first concave portion, for engaging a second concave portion of another block so as to connect and hold said housing to the another block;

a bearing member fixed within said block toy so as to define an opening within said housing aligned along the longitudinal axis;

a drive shaft, rotatably mounted along the longitudinal axis and in the opening of said bearing member so as to receive the drive force and to provide it to the drive shaft of the another block, said drive shaft being structured to engage said bearing member so as to restrict longitudinal movement of said drive shaft with respect to said bearing member.

4. A block toy according to claim 3, wherein said drive shaft has a longitudinal axis and further includes holding means for restricting movement of said drive shaft within said housing in a direction along the longitudinal axis.

5. A block toy according to claim 4, wherein said holding means comprises:

first collar means, positioned about a first end of said drive shaft, for restricting movement of said drive shaft in a first direction along the longitudinal axis; and second collar means, positioned about a second end of said drive shaft, for restricting movement of said drive shaft in a second direction along the longitudinal axis.

6. A block toy according to claim 5, wherein said first collar means comprises a protrusion integrally formed with said drive shaft.

7. A block toy according to claim 6, wherein said second collar means comprises protrusions respectively formed on a top half and a bottom half of said first end of said shaft.

8. A block toy connectable to receive a drive force, comprising:

a plurality of hollow cubes, each having first and second opposing, open sides;

a plurality of coupling collars, each being fixed to and positioned about the first open side of a corresponding one of said cubes and being dimensioned so as to engage the second open side of another one of said cubes and to hold said engaged cubes together;

a plurality of bearing members, each being fixed within a corresponding one of said cubes; and a plurality of drive shafts, each being rotatably mounted within a corresponding one of said bearing members between said first and second open sides and being connectable to one of said drive shafts so as to receive the drive power and to provide it to the drive shaft of the another one of said cubes, each of said drive shafts having a protrusion mounted thereon so as to cooperate with said corresponding bearing member so as to limit axial movement of said drive shaft within said corresponding bearing member.

9. A block toy according to claim 8, wherein each of said drive shafts comprises a shaft having a first end with a recess formed therein and a second end having a protrusion.

10. A block toy according to claim 9, wherein said recess extends into the first end so as to form a top half and a bottom half of the first end, and wherein said top half and bottom half can be elastically displaced towards and away from each other.

11. A block toy according to claim 8, further comprising:

power means, operatively connectable to said housing and to said transmission means, for providing the drive force to said transmission means so as to rotate said transmission means;

power switching means for receving the drive force for selectably providing the drive force to a first plurality of rotatable outputs, each output being operatively connectable to said housing and to said transmission means;

power transmission means, operatively connectable to said housing and to said transmission means, for receiving the drive force and for transmitting the drive force to a second plurality of rotatable outputs; and hinged transmission means, having an input end, an output end rotatably connected to said input end, and being connectable to said housing, for receiving said drive force at said input end and for transmitting said drive force to said output end regardless of the orientation of said output end with respect to said input end.

12. A block toy according to claim 8, wherein each of said drive shafts has mounted thereon an additional protrusion that is positioned so that the protrusion and the additional protrusion are located on opposing sides of said corresponding bearing member so as to prevent axial movement of said drive shaft.

* * * * *